US007600471B2

(12) United States Patent
Westby

(10) Patent No.: US 7,600,471 B2
(45) Date of Patent: Oct. 13, 2009

(54) HAND PROOFER TOOL

(76) Inventor: Ronald K. Westby, 7059 - 166$^{th}$ Ave, NW., Ramsey, MN (US) 55303

( * ) Notice: Subject to any disclaimer, the term of this patent is extended or adjusted under 35 U.S.C. 154(b) by 84 days.

(21) Appl. No.: 11/382,435

(22) Filed: May 9, 2006

(65) Prior Publication Data

US 2007/0006750 A1 Jan. 11, 2007

Related U.S. Application Data

(60) Provisional application No. 60/679,482, filed on May 10, 2005.

(51) Int. Cl.

| | |
|---|---|
| ***B41F 5/00*** | (2006.01) |
| ***B41F 7/00*** | (2006.01) |
| ***B41F 9/00*** | (2006.01) |
| ***B41F 11/00*** | (2006.01) |
| ***B41K 1/22*** | (2006.01) |
| ***B41F 1/34*** | (2006.01) |
| ***B41L 5/16*** | (2006.01) |
| ***B41L 15/14*** | (2006.01) |
| ***B41K 1/56*** | (2006.01) |
| ***B05C 1/06*** | (2006.01) |
| ***B05C 1/08*** | (2006.01) |
| ***B43M 11/02*** | (2006.01) |

(52) U.S. Cl. ..... 101/329; 101/480; 101/216; 101/405; 118/262; 401/218

(58) Field of Classification Search ..... 101/329, 101/328, 327, 480, 216, 405; 118/262; 401/208, 401/218

See application file for complete search history.

(56) References Cited

U.S. PATENT DOCUMENTS

| | | | | |
|---|---|---|---|---|
| 1,442,287 | A * | 1/1923 | Mattern | 101/216 |
| 2,611,914 | A * | 9/1952 | Vanasse | 401/218 |
| 3,122,840 | A * | 3/1964 | Karstens | 33/375 |
| 3,167,009 | A * | 1/1965 | Sloane | 101/329 |
| 4,630,952 | A * | 12/1986 | Elbaum | 401/48 |
| 4,852,486 | A * | 8/1989 | Ely et al. | 101/218 |
| 5,140,899 | A * | 8/1992 | Greer et al. | 101/348 |
| 6,378,426 | B1 * | 4/2002 | Furr et al. | 101/329 |
| 6,422,143 | B1 * | 7/2002 | Lawrence et al. | 101/216 |
| 6,814,001 | B2 * | 11/2004 | Westby et al. | 101/218 |
| 2003/0089255 | A1 * | 5/2003 | Rogge et al. | 101/248 |

* cited by examiner

*Primary Examiner*—Judy Nguyen
*Assistant Examiner*—Leo T Hinze
(74) *Attorney, Agent, or Firm*—Patterson, Thuente, Skaar & Christensen, P.A.

(57) ABSTRACT

A proofing tool including an anilox roll and an impression roll that are shiftable relative to each other between an engaged position and a disengaged position. The invention further includes a positive rotational linkage between the anilox roll and the impression roll whereby a pitch velocity of the anilox roll and a pitch velocity of the impression roll are substantially matched.

21 Claims, 6 Drawing Sheets

HAND PROOFER TOOL

CLAIM TO PRIORITY

This application claims priority to U.S. Provisional Patent Application Ser. No. 60/679,482 entitled "Hand Proofer Tool" filed May 10, 2005 which is incorporated herein in its entirety by reference.

RELATED APPLICATIONS

This application is also related to a concurrently filed utility application being filed the same day entitled "Hand Proofer Tool," U.S. application Ser. No. 11/382,381.

FIELD OF THE INVENTION

The present invention relates generally to the field of flexographic printing and, more particularly, to portable flexographic ink proofing apparatus for providing proofs of ink samples.

BACKGROUND OF THE INVENTION

In the field of flexographic printing ink samples are obtained by drawing ink over a substrate using a hand ink proofer, for example, of the type manufactured by Harper Companies International of Charlotte, N.C. Ink is applied to the substrate by manually rolling the hand proofer across the substrate. Manual ink proofer tools are utilized for proofing ink colors in order to accurately predict the results to be obtained by running a selected ink specimen in a printing press. A computer microscope is then used to view the ink smear on the substrate. The computer then indicates to the technician various color components to be added to the ink in order to achieve the desired ink coloration.

In a flexographic printing operation, rubber plates are utilized for delivering the ink to the stock or paper to be printed. A flexographic ink technician is usually given an ink specimen which has been determined to be acceptable for use on a particular press, and a production run sample, to be used as the standard for color and density. One of the most difficult tasks facing a flexographic ink technician is proofing ink in a manner so that the color will duplicate the color of the production run sample from the flexographic printing press. It is well known among those skilled in the art that if three trained technicians pull an ink proof, using the same ink on the same hand proofer tool, three different color shades will result.

The shade of a color on a flexographic printing press is dependent on the thickness of the ink film applied to the substrate or stock. The ink film thickness is determined by the speed of the press, the pressure applied between the printing plate and paper (i.e., impression), and the pressure between the rollers on the printing unit. Similarly, the shade of a color on a flexographic hand proofer tool is also dependent on the thickness of the ink film applied to the substrate which is determined by the speed at which the technician pulls the hand proofer tool across the substrate, and the impression pressure the technician applies to the hand proofer tool while moving it across the substrate. Thus, the speed and impression are totally dependent on the manual skill of the flexographic ink technician, while the only variable not controlled by the technician is the pressure between the ink roller and transfer roller of the manual proofer tool.

U.S. Pat. No. 6,814,001 describes an ink proofer designed to overcome the problems associated with conventional manual proofer tools by generating consistent and reliable ink draws using a hand-held proofer tool retained in a movable mounting assembly. A variable pressure system is coupled to the mounting assembly to move the proofer tool into a contact position with a cylindrical drum. The transfer roller of the proofer tool then transfers ink to a substrate inserted between the drum and the transfer roller of the proofer tool when a drive motor for the drum is engaged.

In prior art proofing tools the anilox roll and the impression roll are engaged to one another only by friction. A doctor blade removes excess ink from the anilox roller by scraping the anilox roller as it turns, and supports welled up ink to maintain a continuing supply of ink to replenish the anilox roller after ink has been transferred to the impression roller. Thus, there is a certain degree of doctor blade pressure on the anilox roller that tends to resist turning of the anilox roller.

In addition, nip pressure exists between the rollers. As the anilox roller and the impression roller meet the viscosity of the ink being transferred from the anilox roller to the impression roller tends to force the anilox roller and the impression roller apart. In conventional hand proofing tools, this force is countered by another force that arise because of the deflection of an adjustable spring in the handle of the tool.

It is desirable that the nip pressure between the anilox roll and the impression roll not be too high. It is known that the sheer force generated by a too high nip pressure between the anilox roll and the impression roll will change the sheer qualities of the ink and thus alter the appearance of the image on the sample that is pulled. It is also desirable to maintain the nip pressure on the proofing tool at a level very similar to the nip pressure on the printing press in order to obtain a similar appearing result between ink tested on the proofing tool and ink that is in production printed materials produced by the press.

In addition, the anilox roller and the impression roller are coupled only by friction. Printing ink may have significant viscosity. If nip pressure is maintained too low, the anilox roll will start skidding on the ink relative to the impression roller. In this circumstance, the impression roller will not be coated with ink properly and gaps will appear in the proof that is drawn. In a prior art proofing tool, doctor blade pressure and/or nip pressure can cause skidding between the anilox roll and the transfer roll.

Another issue arises because of slippage between the anilox and the impression roller is that transfer of ink from the anilox roller to the impression roller may vary, thus, causing variation in the proof produced.

Another issue arises with prior art hand proofing tools because it is desirable to separate the anilox roll from the impression roller when the proofer is not in use. If the anilox roll and the impression roll remain in contact with one another indentation of the impression roll or damage to the anilox roll will tend to occur thus causing an uneven transfer of ink and making the anilox roll impression roll assembly useless for providing a good proof. Prior art hand proofers generally include a release mechanism to release pressure between the anilox roll and the impression roll. However, this pressure release mechanism must be manually operated. If an operator forgets to operate the pressure release mechanism the rolls may be compromised.

Yet another issue that arises with prior art proofers is that if the proofer is set down on a surface the impression roller will make contact with that surface. This causes transfer of ink from impression rolls of the surface creating a mess that must be cleaned up and, in addition, may cause foreign material to be picked up on the surface of the impression roller which may then be turned and rotated into the anilox roller thus damaging the anilox roller or the impression roller or both.

Another shortcoming of many prior art hand proofers is that, when in use, the anilox and transfer roll are in a non-vertical orientation relative to one another. A printing press is arranged so that the anilox and impression roll are in a vertical position during use, thus, gravity affects the transfer of ink between the anilox and the transfer roll. In making a proofer that gives the most reliable possible proofs it would be desirable to duplicate the relationship between the anilox and the transfer roll that is seen in printing presses.

SUMMARY OF THE INVENTION

The present invention solves many of the above-discussed problems. In one aspect, the invention is a proofing tool including an anilox roll, and an impression roll. The impression roll and the anilox roll are shiftable relative to each other between an engaged position where the impression roll is engaged with the anilox roll and a disengaged position where the impression roll is disengaged from the anilox roll. An anilox support member supports the anilox roll and an impression support member supports the impression roll such that the anilox roll and the impression roll are oriented substantially parallel and separated by a nip distance. The invention also includes a positive rotational linkage between the anilox roll and the impression roll so that the pitch velocity of the anilox roll and the pitch velocity of the impression roll are substantially matched.

The invention includes a proofing tool, having an anilox roll and an impression roll. The impression roll and the anilox roll are shiftable relative to each other between an engaged position where the impression roll is engaged with the anilox roll and a disengaged position wherein the impression roll is disengaged from the anilox roll. The invention further includes an anilox support member supporting the anilox roll and an impression support member supporting the impression roll such that the anilox roll and the impression roll are oriented substantially parallel to one another and separated by a nip distance. The invention further includes a positive stop nip adjustment mechanism operably connected to the anilox roll and the impression roll which is adjustable so that when the anilox roll and the impression roll are in the engaged position the positive stop prevents the nip distance from being smaller than a set value.

In another aspect, the invention includes a gear driven anilox proofing tool with a positive stop adjustment of nip distance. The present invention includes a proofing tool that has a positive rotating connection between the anilox roller and the impression or transfer roller so that no matter how light the nip pressure is the speed of the rollers remains matched. The positive rotating connection matches the pitch velocity of the anilox roll with the impression roll whether the anilox roll and the impression roll are of similar or varying diameters.

In addition, the present invention allows the nip of the proofing tool to closely simulate the nip of the printing press so that the shear properties of the ink are not affected significantly differently in the proofing tool than in the printing press, which would lead to variations in color, density and shade between the proof and the printed result. A gear drive between the anilox roll and the transfer roll prevents slipping between the anilox roll and the transfer roll. The gear drive also allows wider variation in pressure ratios without slipping.

The proofing tool of the present invention is also adapted for use with a proofing machine that has a drive roll. A typical proofing machine has a drive roll that is formed of rubber. Often, a drive roll is formed of 60 durometer rubber. The present invention creates positive or semi-positive drive between the drive roll of the proofing machine and the transfer roll of the hand proofer. For the purposes of this application, a positive drive will be considered a drive that has essentially no slippage between the impression roller and the drive roller in the case of an automated proofing arrangement and the impression roller and the surface that supports the substrate in the case of a hand proofing arrangement. In other words a positive drive in accordance with the present invention maintains the pitch velocities of the anilox roll and the impression roll to be substantially equal. An exemplary positive drive includes a gear tooth engagement between the impression roll and the drive roller or supporting surface. A semi-positive drive will be considered a drive that has limited slippage between the impression roller and the drive roller in the case of an automated proofing arrangement and the impression roller and the surface that supports the substrate in the case of a hand proofing arrangement. An exemplary semi-positive drive includes a high friction engagement between the impression roll and the drive roller or supporting surface. For example, a gear rolling on a resilient rubber surface creates a semi-positive drive. A positive or semi-positive drive allows lighter nip pressure on the substrate even with high contact pressure between the anilox roll and the impression roll.

This is particularly helpful for film drawdowns. In addition, the positive or semi-positive drive between the drive roll and the transfer roll allows for higher doctor blade pressures. The positive or semi-positive drive between the drive roll and the transfer roll may be accomplished by the gears on either side of the transfer roll engaging with the drive roll instead of the drive roll engaging the paper which then in engages the transfer roll by friction.

Another aspect of the present invention is that when the proofer of the present invention is not in use the pressure between the anilox roll and the impression roll is automatically released. Automatically relieving pressure between the anilox roll and the impression roll prevents damage to the anilox roll and the transfer roll during periods of non-use. In addition, since this release of pressure happens automatically it is not necessary for an operator to remember to release the pressure in order to prevent harm. Operator error is, thus, less likely to create problems.

Another aspect of the present invention is that the nip is adjustable by positive displacement rather then by the application of variable spring pressure. In the present invention the nip is set by displacement adjustable by one or more micrometer thimbles built into the proofing tool. This allows for consistent, repeatable displacement between the anilox roll and the impression roll and better approximates the nip of the printing press, thus allowing more reliable consistent proofing of the resulting material.

The hand proofer of the present invention may be operated manually or may be used with a proofing machine.

In another aspect, the present invention lends itself to particularly easy cleaning for removing inks to allow for multiple proofing of multiple color inks without significant delay.

Another benefit of the present invention is that it may be adapted to use readily available anilox rolls from multiple suppliers currently in the market.

Another aspect of the present invention is that when it is used for proofing, the anilox and transfer rolls are oriented in a vertical position relative to one another. This vertical orientation of the anilox roll above the transfer roll simulates the orientation found in a printing press so that the effect of gravity on ink in the cell structure of the anilox roll is similar to that found in the printing press. This provides for more reliable consistent proofing that is more comparable to the results that will be seen in the printing press when the actual print run is made.

The proofing tool of the present invention generally includes an anilox support, an impression support, an anilox roll, an impression roll and a positive roll drive. The anilox support and the impression support are substantially parallel in substantially similar yoke shaped structures adapted to support the anilox roll and the impression roll respectively. The anilox support and the impression support are connected to one another at an end distal from the anilox roll and the impression roll. The anilox support and the impression support can flex relative to one another in a limited, controlled fashion.

The anilox roll and the impression roll are supported in close proximity to one another on independent axles so that they can roll relative to one another. In one aspect of the invention, the anilox roll and the impression roll are interconnected by an anilox gear and impression gear. The anilox gear and the impression gear mesh to provide a positive rotation of the anilox roll related to the impression roll so that slippage cannot occur and pitch velocity is maintained equal between the two.

The anilox support and the impression support are separated by a short gap and one or two micrometer thimbles are interposed so that the micrometer thimbles can be adjusted to accurately alter the spacing between the impression support and the anilox support. The micrometer thimbles create a positive stop so that the distance between the anilox roll and the impression roll, when they are engaged, can be precisely and repeatably set. The positive stop sets a minimum distance that can be achieved between the anilox roll and the impression roll. Thus, the spacing between the anilox support and the impression support may be repeatedly and precisely set.

In another aspect to the invention there may be an impression gear located at each end of the impression roll. Thus, when the proofing tool is used with a mechanical proofer the impression gears on each side of the impression roll engage with the drive roll to create a positive or semi-positive drive between the drive roll and the transfer roll.

The anilox roll and the transfer roll of the present invention are oriented so that, in use, they are in vertical position with the anilox roll above the impression roll. This duplicates the arrangement in a printing press such that the effect of gravity on ink transfer between the anilox roll and the impression roll is similar to that in a printing press producing more reliable and consistent proofs.

DETAILED DESCRIPTION OF THE INVENTION

Figure 1:
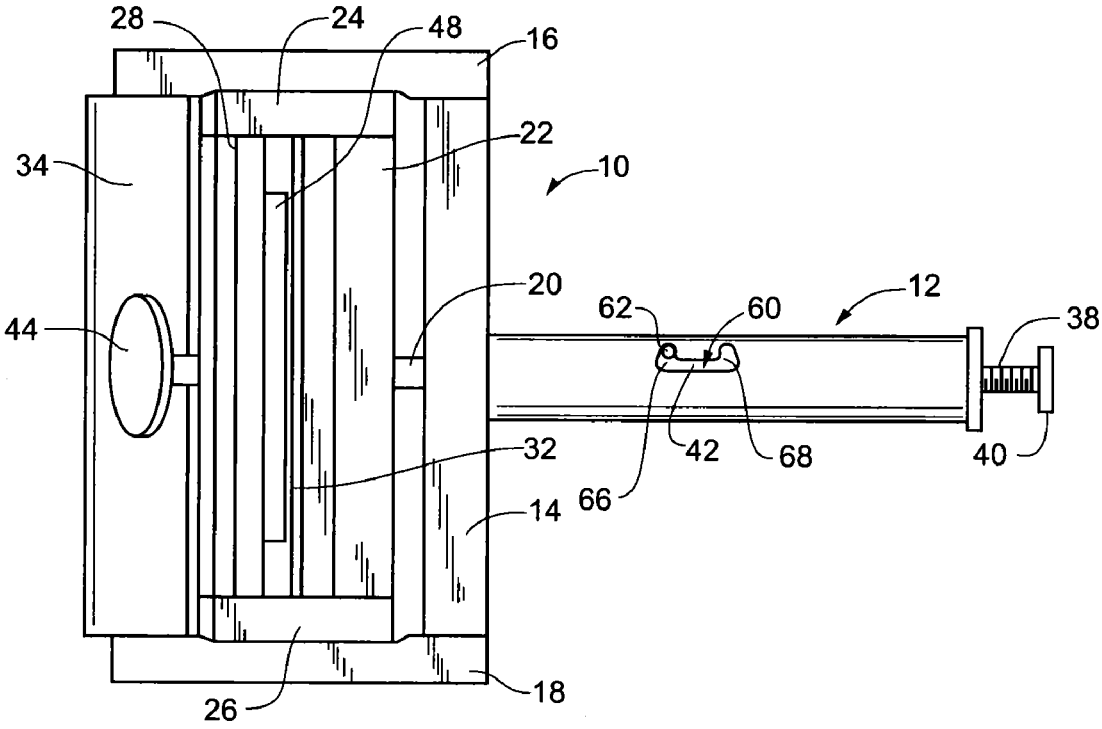
Fig. 1 Prior Art
FIG. 1 is a plan view of a prior art hand proofing tool.
Figure 2:
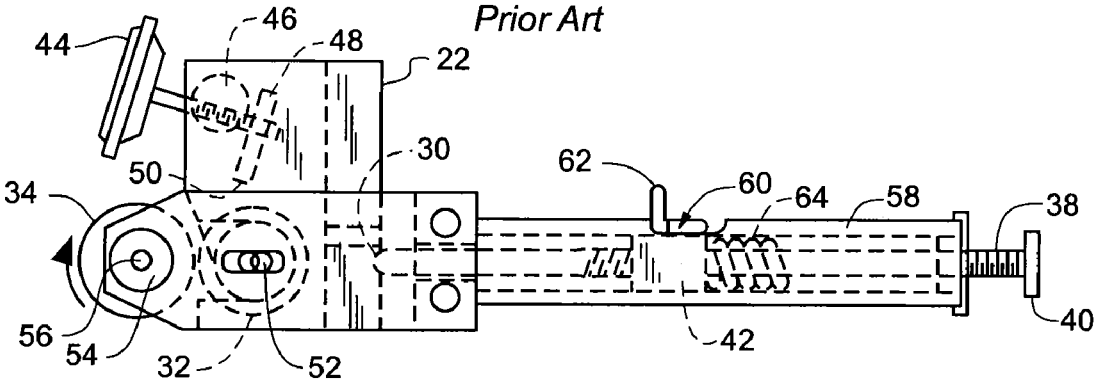
Fig. 2 Prior Art
FIG. 2 is a elevational view of the prior art hand proofing tool.

Referring to FIGS. 1 and 2, an exemplary prior art hand proofing tool 10 includes handle 12, base frame 14 and sideframes 16 and 18. Base frame 14 has a hole that accommodates pressure rod 20 along with a threading for attaching handle 12 to base frame 14. Sideframes 16 and 18 extend outwardly from base frame 14. Connected to sideframes 16 and 18 of base frame 14 is anilox roll-nesting subframe 22. Subframe 22 has sides 24 and 26, as well as a blade adjustment means holder 28. Additionally, subframe sides 24 and 26 may be grooved and sideframes 16 and 18 may be likewise grooved in a complementary fashion so that they fit into one another. Indentation 30 receives pressure rod 20 and helps maintain proper alignment of the subframe 22 within sideframes 16 and 18.

Anilox roll 32 is located within nesting subframe 22 such that anilox roll pin 34 extends from anilox roll 32 at least partially into or through elongated orifices 36, on each of sideframes 16 and 18. Anilox roll 32 is pressed against transfer roll 34 and pressure rod 20 maintains the pressure against nesting subframe 22 so that it forces anilox roll 32 against transfer roll 34 at a predetermined pressure resulting from rotation of pressure rod adjustment means 38, by rotating gripping dial 40, for example, clockwise to tighten and counterclockwise to loosen. Pressure rod adjuster 38 is threaded and fits into pressure rod release means collar 42. Collar 42 is held in a position so that as pressure rod adjustment means 38 is rotated it causes the subframe 22 and anilox roll 32 to move accordingly.

Connected to subframe blade adjustment means holder 28 is blade adjustment means 44, in this case, a rotatable dial which includes screw 46 which passes through holder 28. At the end of screw 46 is blade holder 48 and doctor blade 50 set up as a follower-type doctor blade 50 so that ink may be located behind the doctor blade 50 and the doctor blade 50 will both act as a wiping blade and as a distributing fountain. By rotation of blade adjustment means 44, for example clockwise to go upwardly away from subframe 22 and counterclockwise to go downwardly, doctor blade 50 may be adjusted against the surface of anilox roll 32 accordingly.

In prior art hand proofing tool 10, the anilox roll 32 has bearings 52 to facilitate ease of rolling. Bearings 52 are adapted to fit over the anilox roll pins 43 and are contained within a washer-type fitting which nests within the subframe 22. Sideframes 16 and 18 each also include transfer roll pin holding insert 54 adapted to receive transfer roll pins 56, as shown.

Handle 12 and hollow member 58, include pressure rod release means 60 which includes a cut-out as shown, pressure rod release means collar 42 and pressure rod release means lever 62, as well as spring 64. Spring 64 is located to push collar 42 and therefore pressure rod adjustment means 38 and pressure rod 20 against subframe 22. When pressure rod release means lever 62 is located in first position 66, pressure rod 20 is engaged with subframe 22 and, therefore, under pressure. The pressure rod release means lever 62 may be pushed clockwise then away from the subframe 22 and then counterclockwise (in other words, in a "U" shaped path), to move from first position 66 to second position 68. In second position 68, pressure rod 20 is totally disengaged from subframe 22 and subframe 22 may be easily removed or rotated for cleaning of anilox roll 32 without altering the setting and therefore the pressure relationship which will be re-achieved when pressure rod release means lever 62 is moved from second position 66 back to first position 68.

Figure 3:
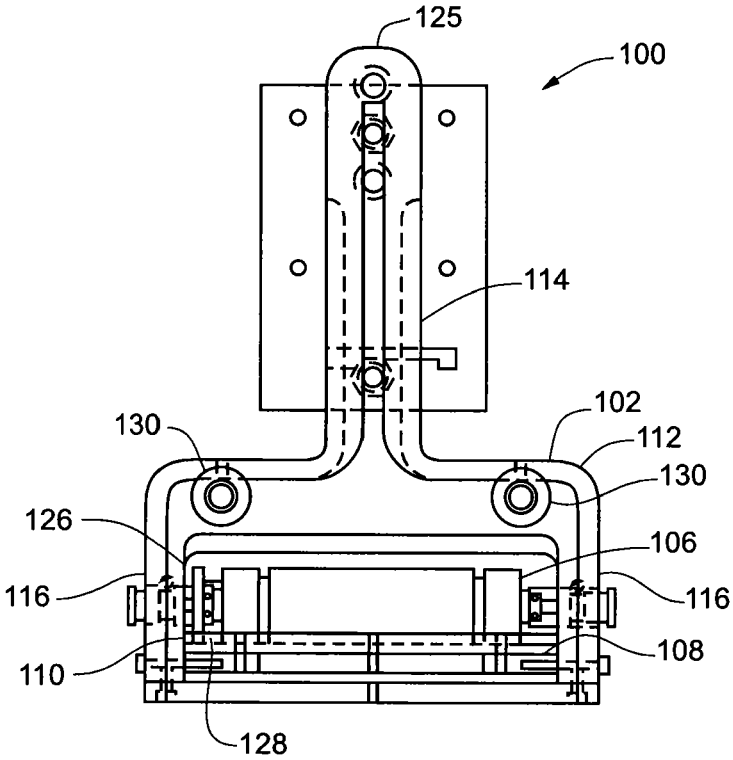
FIG. 3 is a plan view of a proofing tool in accordance with the present invention.
Figure 4:
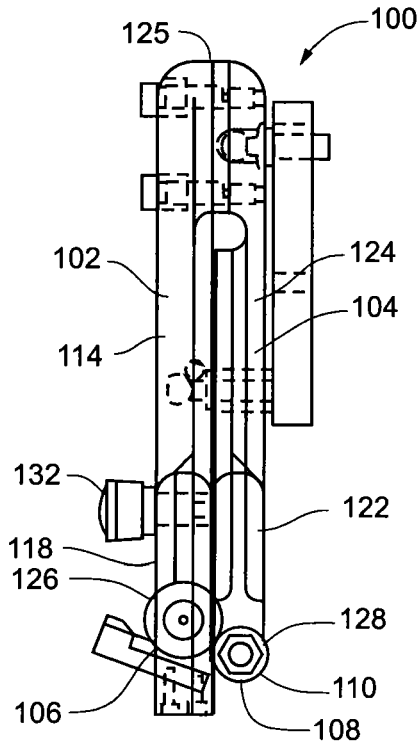
FIG. 4 is an elevational view of a proofing tool in accordance with the present invention.

Referring to FIGS. 3 and 4 proofing tool 100 generally includes anilox support, impression support 104, anilox roll 106, impression roll 108 and positive roll drive 110. Anilox support 102 and impression support 104 are similar but not identical structures. Proofing tool 100 includes a doctor blade that is not shown in FIG. 3 for clarity. An exemplary doctor blade and pressure bar are depicted in FIG. 4, 5-7 and 9-10.

Anilox support 102 generally includes yoke 112 and extended portion 114. Yoke 112 supports anilox roll 106 between two arms 116. Likewise, impression support 104 includes yoke 122 and extended portion 124. Anilox roll 106 and impression roll 108 are supported between the arms of yoke 112 and yoke 122 respectively. Anilox support 102 and impression support 104 are connected only at distal end 125 of extended portions 120 and 124. Otherwise, anilox support 102 and impression support 104 are oriented substantially parallel with a small gap between them. Impression support 104 is capable of some flexing movement from a disengaged position to an engaged position such that impression roll 108 is held slightly more separated from anilox roll 106 when no force is applied to impression roll 108 than when impression roll is in contact with a printing substrate.

Positive roll drive 110 generally includes anilox gear 126 and impression gear 128. As best seen in FIGS. 3 and 4, anilox gear 126 and impression gear 128 mesh together to synchronize the motion of anilox roll 106 and impression roll 108. In one embodiment of the invention, there is a single set of anilox gear 126 and impression gear 128. Another embodiment of the invention includes one anilox gear 126 and two impression gears 128. If one anilox gears 126 and two impression gears 128 are present, one anilox gear 126 is located on one end of anilox roll 106 and two impression gears 128 are located on each end of impression roll 108 respectively.

Proofing tool 100 also includes one or more micrometer thimbles 130. Two micrometer thimbles 130 may be used to allow independent adjustment to ensure equal nip spacing across the width of anilox roll 106 and impression roll 108. Micrometer thimbles 130 are positioned so that the measuring surfaces of spindles (not shown) contact impression support 104 to determine a minimum nip spacing between anilox roll 106 and impression roll 108. Gear teeth 131 of impression gear 128 extend beyond impression roll 108, in part, so that if the proofing tool 100 is set down on a flat surface there will be a standoff created and impression roll 108 will not touch the surface.

Anilox gear 126 and impression gear 128 may be formed with fine pitch gear teeth to prevent gear chatter. In one aspect of the invention, the gear teeth mesh such that the gears are separated by slightly more than a true pitch diameter to allow for adjustment of nip without the need to change gears.

Optionally, proofing tool 100 may include a separation device (not shown) which can be utilized to force anilox support 102 apart from impression support 104 a slight distance to ensure separation between anilox roll 106 and impression roll 108 when not in use.

Proofing tool 100 may be formed substantially from aluminum alloy or from other materials known to the art.

Referring to FIGS. 5-8 proofing tool 100 includes pressure bar 134, doctor blade holder 136 and doctor blade 138. Pressure bar 134 is located at the end of yoke 122. Doctor blade holder 136 is pivotably secured to the arms of yoke 122. Doctor blade holder 136 secures doctor blade 138 by clamping or another technique known to the art. Doctor blade holder 136 has a relief cut into it, to allow positioning of the doctor blade 138 precisely parallel to anilox roll 136. Adjusting screw 140 passes through pressure bar 134 to bear on doctor blade holder 136. Adjusting screw 140 adjust the pressure of doctor blade 138 on anilox roll 106. Doctor blade holder 136 is pivotably attached to arms 116 of yoke 118.

In one embodiment of the invention, doctor blade 138 meets anilox roller 106 at approximately a 30 degree pressure angle. If the diameter of the anilox roll 106 is changed it may be necessary to change doctor blade holder 136 or to relocate the pivotable mounting of doctor blade holder 136. Alternately, the position of anilox roll 106 may be changed, for example by the use of a bushing having an eccentrically located hole therein.

Figure 5:
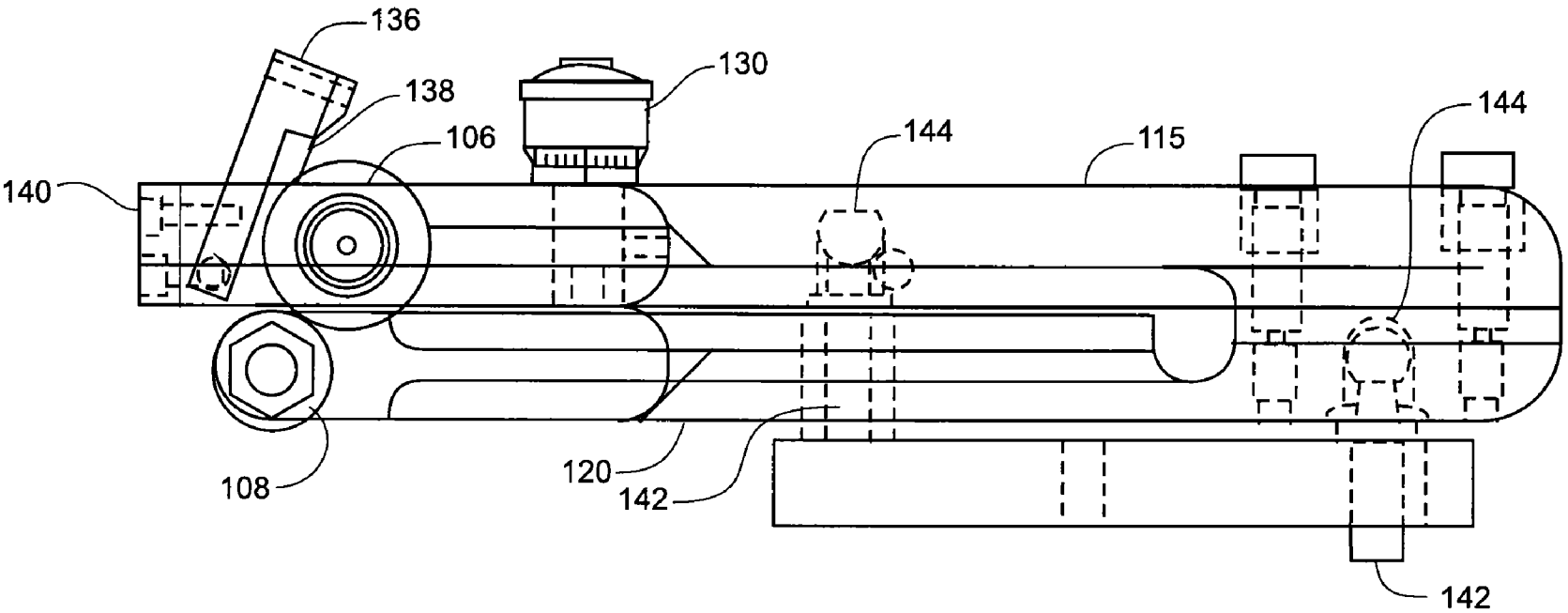
FIG. 5 is an elevational view of another proofing tool in accordance with the present invention with some structures shown in phantom.

Still referring particularly to FIG. 5, ball ends 142 may be used to removably secure proofing tool 100 to an automated proofing machine (not shown.) If ball ends 142 are utilized, proofing tool 100 includes ball sockets 144 to receive ball ends 142 therein. Proofing tool 100 may also include one or more slide lockpins 146 located in an aperture in proofing tool 100 to secure proofing tool 100 to one or more ball ends 142 at ball sockets 144.

The orientation of the doctor blade 138 in the present invention is reversed from that in known conventional prior art proofing tools. Orientation reversal allows the introduction of a felt dam 147 adjacent to the doctor blade 138. The application of a felt dam 147 allows for the maintenance of a larger volume of ink in the well adjacent the doctor blade 138 which is useful, particularly, in long draw downs.

Figure 6:
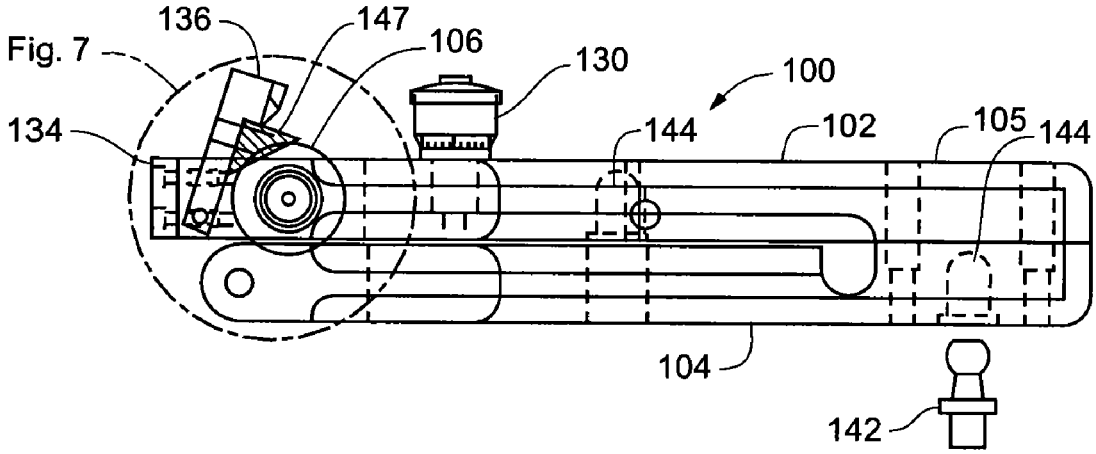
FIG. 6 is an elevational view of the proofing tool of FIG. 5 with some structures shown in phantom and some structures removed for clarity.
Figure 7:
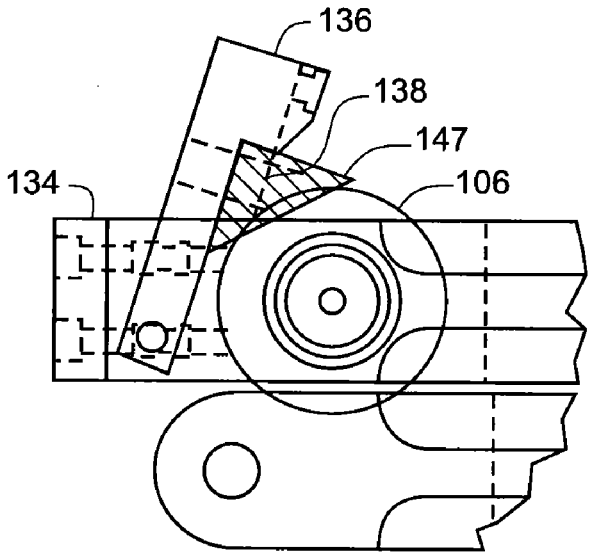
FIG. 7 is a detailed view taken from FIG. 6 with some structures shown in phantom.
Figure 8:
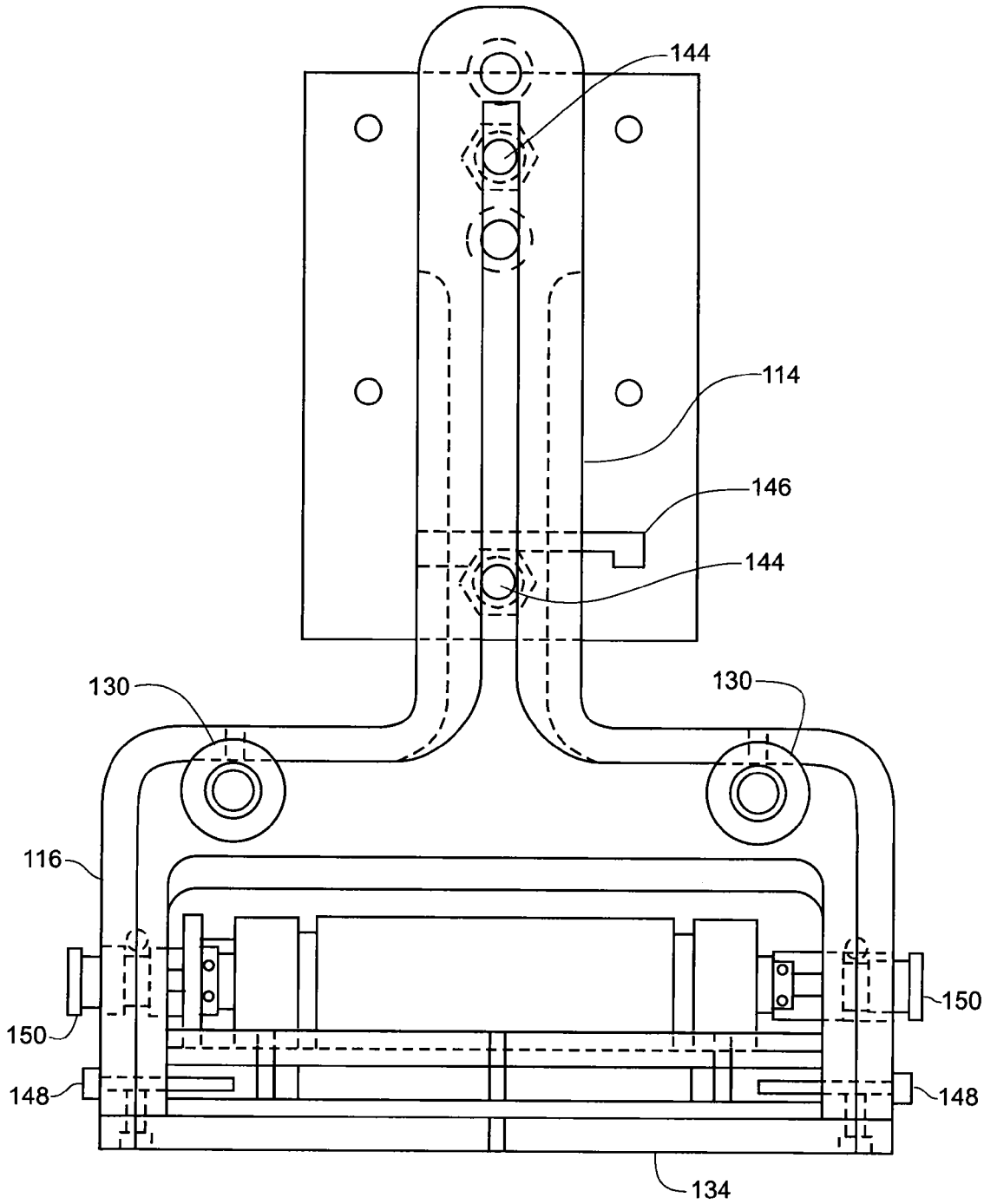
FIG. 8 is a sectional plan view of a proofing tool in accordance with the present invention with some structures shown in phantom.

Referring to FIGS. 5, 6 and 8, note that extended portion 115 and extended portion 120 of anilox support 102 and impression support 104 may be milled to thin them. The level of milling can be altered to adjust the flexibility of anilox support 102 relative to impression support 104 allowing for adjustment of the relative flexion of anilox support 102 relative to impression support 104.

Anilox roll 106 and impression roll 108 may be supported in anilox support 102 by precision ball bearings, sleeve bearings or bushings. Anilox roll 106 or impression roll 108 may be supported at a one end by fixed bearing 148 and at a second end by moveable bearing 150. One or both of anilox roll 106 or impression roll 108 may be supported at both ends by fixed bearing 148 or by moveable bearing 150. Fixed bearing 148 and moveable bearing 150 may be, for example, Delrin bearings. Moveable bearing 150 may be adjustable so as to be loosened to remove impression roll 108 and tightened to secure impression roll 108 in place for use.

In another embodiment of the invention, the drive roll of a proofing machine (not shown) may include a drive roll gear 152 such that impression gear 128 engages the drive roll gear 152 so that the drive roll gear drives impression gear 128 which in turn drives anilox gear 126 providing a positive drive engagement between a drive roll (not shown), impression roll 108 and anilox roll 106.

In another embodiment of the invention, proofing tool 100 may incorporate an auxiliary ink reservoir (not shown). Auxiliary ink reservoir may include a drip line and a valve to allow the institution of a steady drip supply to replenish a well of ink at doctor blade 138.

Figure 9:
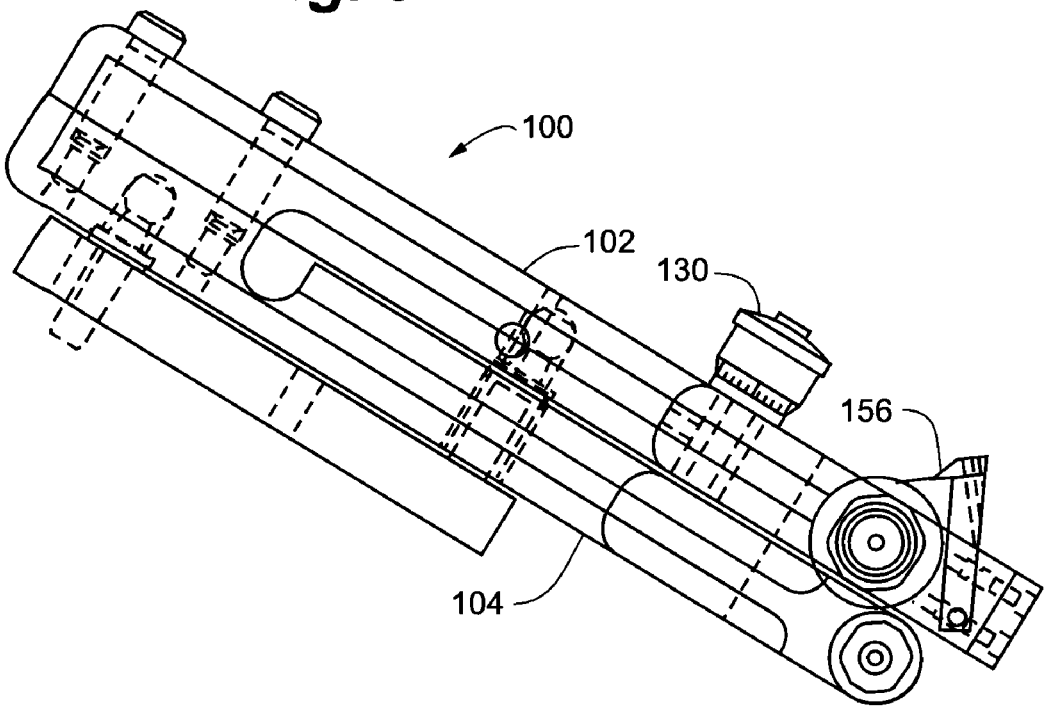
FIG. 9 is an elevational view of a proofing tool in accordance with the present invention including a leading edge doctor blade with some structures shown in phantom.
Figure 10:
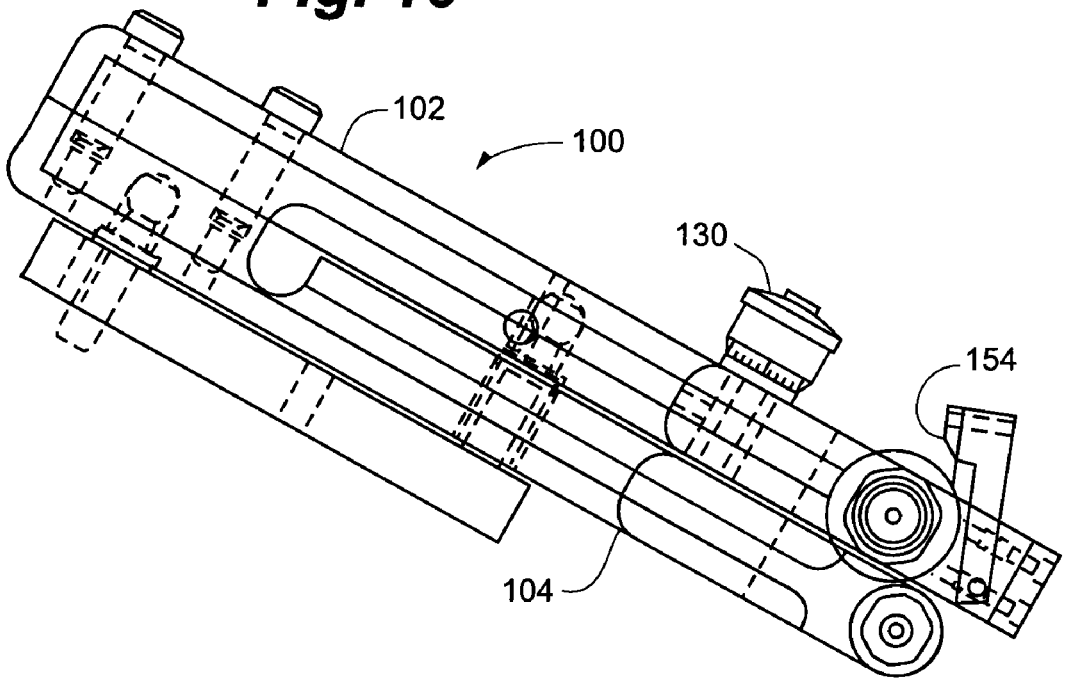
FIG. 10 is an elevational view of a proofing tool in accordance with the present invention including a trailing edge doctor blade with some structures shown in phantom.

Referring to FIGS. 9 and 10, doctor blade 138 may include trailing edge doctor blade as depicted in FIG. 10 or leading edge doctor blade as depicted in FIG. 9. Trailing edge doctor blade 154 tends to force ink into anilox roll 106 while leading edge doctor blade 156 tends to meter the amount of ink by shearing off excess ink from the anilox roll 106. Another embodiment of proofing tool 100 may include both a trailing edge doctor blade 154 and a leading edge doctor blade 156 acting on a single anilox roll 106. This embodiment may be especially advantageous when proofing tool 100 is used with highly viscous inks. Highly viscous inks may tend to overwhelm the force of a trailing edge doctor blade 154 toward the anilox roll 106 and "hydroplane" the trailing edge doctor blade.

In operation, referring to FIGS. 3 through 10, proofing tool 100 is used to prepare ink proofs for flexographic printing processes. An operator sets a nip distance between anilox roll 106 and impression roll 108 by adjusting micrometer thimbles 130. After micrometer thimbles 130 are adjusted to a desired nip distance ink is applied between doctor blade 138 and anilox roll 106. If present, felt dam 147 is saturated with ink.

If a proof is to be hand pulled, an operator grasps proofing tool 100 by extended portion 144 and extended portion 120 and orients proofing tool 100 so that anilox roll 106 is substantially vertically above impression roll 108. Impression roll 108 is then brought into contact with a substrate and proofing tool 100 is drawn along the substrate. Ink is then transferred from anilox roll 106 to impression roll 108 with the amount of ink being transferred being controlled by doctor blade 138 and the qualities of anilox roll 106. Ink from impression roll 108 is transferred to the substrate creating an ink proof.

If proofing tool 100 is used with an ink proofing machine (not shown) proofing tool 100 is prepared for proofing in a process similar to that described above. Proofing tool 100 is then attached to proofing machine (not shown) by connecting ball sockets 144 to ball ends 142.

A substrate is inserted between impression roll 108 or proofing tool 100 and a drive roll (not shown) of ink proofing machine (not shown).

If positive roll drive 110 is present, impression gear 128 may be engaged to a drive roll gear (not shown) so that as drive roll (not shown) rotates the drive roll gear it meshes with impression gear 128 and rotates impression roll 106. Impression gear 128 engages with anilox gear 126 and rotates anilox roll 106, thus preventing slippage between the drive roll (not shown), impression roll 108, and anilox roll 106.

When proofing tool 100 is released from contact with the substrate, anilox roll 106 and impression roll 108 are separated by the resiliency of extended portion 120 and extended portion 124.

The present invention may be embodied in other specific forms without departing from the spirit of the essential attributes thereof, therefore, the illustrated embodiments should be considered in all respects as illustrative and not restrictive, reference being made to the appended claims rather than to the foregoing description to indicate the scope of the invention.

What is claimed is:

1. A hand holdable proofing tool, comprising:

an anilox roll;

an ink transfer roll, the ink transfer roll and the anilox roll being shiftable relative to each other;

an anilox support member supporting the anilox roll, the anilox support member comprising a first yoke having a first arm that supports the first end of the anilox roll and a second arm that supports the second end of the anilox roll and a first extended beam portion, the first extended beam portion being coupled to the first yoke and extending outwardly away from anilox roll;

an ink transfer support member supporting the ink transfer roll such that the anilox roll and the ink transfer roll are oriented substantially parallel and separated by a nip distance, the ink transfer support member comprising a second yoke having a third arm that supports the first end of the transfer roll and a fourth arm that supports the second end of the transfer roll a second extended beam portion coupled to the second yoke and extending outwardly away from the ink transfer roll in substantially parallel spaced apart relation with and distally coupled to the first extended beam portion, the second yoke being non-coplanar with and spaced apart from the first yoke;

at least one of the first extended beam portion or the second extended beam portion including a portion having reduced cross sectional area to facilitate flexing relative to the other of the first extended beam portion or the second extended beam portion; and a rotational linkage between the anilox roll and the ink transfer roll whereby a pitch velocity of the anilox roll and a pitch velocity of the ink transfer roll are substantially matched.

2. The proofing tool as claimed in claim 1, further comprising a positive stop nip adjustment mechanism operably connected to the anilox roll and the ink transfer roll and whereby when the anilox roll and the ink transfer roll are in the engaged position the positive stop prevents the nip distance from being smaller than a set value.

3. The proofing tool as claimed in claim 2, wherein the positive stop nip adjustment mechanism further comprises a micrometer thimble.

4. The proofing tool as claimed in claim 1, wherein the first and second extended beam portions are fixedly joined at a location distal from both the anilox roll and the transfer roll and supported in resilient bendable relationship to one another.

5. The proofing tool as claimed in claim 1, wherein at least one of the first extended beam portion and the second extended beam portion is resiliently bendable such that when the transfer roll is not in contact with a substrate the anilox roll and the transfer roll shift to the disengaged position without operator action.

6. The proofing tool as claimed in claim 1, wherein the positive rotational linkage comprises a first gear operably coupled to the anilox roll and a second gear operably coupled to the transfer roll.

7. The proofing tool as claimed in claim 1, wherein the positive rotational linkage is operably couplable to a drive roll on a proofing machine whereby the pitch velocity of the anilox roll the pitch velocity of the transfer roll and a pitch velocity of the drive roll are substantially matched.

8. The proofing tool as claimed in claim 1, wherein, when the proofing tool is in a position for drawing proofs, the anilox roll is positioned substantially vertically above the ink transfer roll.

9. A proofing tool, comprising:

an anilox roll;

an ink transfer roll;

means for supporting the anilox roll;

means for supporting the ink transfer roll such that the anilox roll and the ink transfer roll are oriented substantially parallel and separated by a nip distance, the means for supporting the anilox roll comprising an anilox support member supporting the anilox roll, the anilox support member comprising a first yoke having a first arm that supports the first end of the anilox roll and a second arm that supports the second end of the anilox roll and a first extended beam portion, the first extended beam portion being coupled to the first yoke and extending outwardly away from the anilox roll and an ink transfer support member comprising a second yoke having a third arm that supports the first end of the transfer roll and a fourth arm that supports the second end of the transfer roll and a second extended beam portion coupled to the second yoke and extending outwardly away from the ink transfer roll in substantially parallel spaced apart relation with and distally coupled to the first extended beam portion, the second yoke being non-coplanar with and spaced apart from the first yoke;

at least one of the first extended beam portion or the second extended beam portion including a portion having reduced cross sectional area to facilitate flexing relative to the other of the first extended beam portion or the second extended beam portion; and means for maintaining the pitch velocity of the anilox roll and the pitch velocity of the ink transfer roll to be substantially equal.

10. The proofing tool as claimed in claim 9, further comprising means for nip adjustment operably connected to the anilox roll and the ink transfer roll, including means for positively stopping movement such that when the anilox roll and the ink transfer roll are in the engaged position the means for positively stopping movement prevents the nip distance from being smaller than a set value.

11. The proofing tool as claimed in claim 10, wherein the means for nip adjustment further comprises a micrometer thimble.

12. The proofing tool as claimed in claim 10, wherein, when the proofing tool is in a position for drawing proofs, the anilox roll is positioned substantially vertically above the transfer roll.

13. The proofing tool as claimed in claim 9, wherein the first and second beam portions are fixedly joined at a location distal from both the anilox roll and the ink transfer roll.

14. The proofing tool as claimed in claim 13, wherein at least one of the first extended beam portion and the second extended beam portion is bendable such that when the ink transfer roll is not in contact with a substrate the anilox roll and the transfer roll shift to the disengaged position.

15. The proofing tool as claimed in claim 9, wherein the means for maintaining the pitch velocity of the anilox roll and the pitch velocity of the ink transfer roll to be substantially equal is operably couplable to means for maintaining pitch velocity of a drive roll on a proofing machine.

16. A method of making a hand proofer tool, comprising supporting an anilox roll by an anilox support member having a first yoke having a first arm that supports the first end of the anilox roll and a second arm that supports the second end of the anilox roll and a first extended beam portion, the first extended beam portion being coupled to the first yoke and extending outwardly away from the anilox roll;

supporting an ink transfer roll by an ink transfer support member such that the anilox roll and the ink transfer roll are oriented substantially parallel and separated by a nip distance, the ink transfer support member comprising a second yoke having a third arm that supports the first end of the transfer roll and a fourth arm that supports the second end of the transfer roll and a second extended beam portion coupled to the second yoke and extending outwardly away from the ink transfer roll in substantially parallel spaced apart relation to the first extended beam portion, the second yoke being non-coplanar with and spaced apart from the first yoke;

joining the first extended beam portion to the second extended beam portion at ends of the first extended beam portion and the second extended beam portion distal from the anilox roll and the ink transfer roll;

forming at least one of the first extended beam portion or the second extended beam portion including a portion having reduced cross sectional area to facilitate flexing relative to the other of the first extended beam portion or the second extended beam portion; and maintaining the pitch velocity of the anilox roll and the pitch velocity of the ink transfer roll to be substantially equal by use of a rotational linkage.

17. The method as claimed in claim 16, operably interposing a positive stop nip adjustment mechanism between the anilox support member and the ink transfer support member; and adjusting the positive stop nip adjustment mechanism such that when the anilox roll and the ink transfer roll are in the engaged position the positive stop prevents the nip distance from being smaller than a set value.

18. The method as claimed in claim 17, further comprising altering nip adjustment using a micrometer thimble.

19. The method as claimed in claim 16, further comprising fixedly joining the first and second beam portions at a location distal from both the anilox roll and the ink transfer roll.

20. The method as claimed in claim 19, further comprising selecting at least one of the first extended beam portion and the second extended beam portion to be resiliently bendable such that when the ink transfer roll is not in contact with a substrate the anilox roll and the ink transfer roll shift to the disengaged position without operator action.

21. The method as claimed in claim 16, further comprising maintaining the pitch velocity of the anilox roll and the pitch velocity of the ink transfer roll to be substantially equal to a pitch velocity of a drive roll on a proofing machine by positive linkage between the drive roll and the ink transfer roll.

* * * * *